United States Patent [19]

Mueller et al.

[11] Patent Number: 5,000,381

[45] Date of Patent: Mar. 19, 1991

[54] WINDOW FAN WITH CONTROLLER

[75] Inventors: Charles V. Mueller, Iowa City, Iowa; Ross L. Bisplinghoff, Norfolk; Christopher Ferguson, Framingham, both of Mass.

[73] Assignee: Raytheon Company, Lexington, Mass.

[21] Appl. No.: 485,857

[22] Filed: Feb. 22, 1990

Related U.S. Application Data

[63] Continuation of Ser. No. 332,192, Mar. 30, 1989, abandoned.

[51] Int. Cl.[5] ..... B01F 3/02

[52] U.S. Cl. ..... 236/44 C; 98/42.04; 165/16; 236/49.3

[58] Field of Search ..... 236/49.3, 44 C, 91 C, 236/44 A, 44 R, DIG. 9; 98/42.04, 39.1, 116, 94.1; 165/16

[56] References Cited

U.S. PATENT DOCUMENTS

| | | | |
|---|---|---|---|
| 2,177,596 | 10/1939 | Haines | 236/91 C X |
| 2,257,462 | 9/1941 | Gildersleeve et al. | 165/16 |
| 2,383,533 | 8/1945 | Crise | 236/49.3 X |
| 2,553,172 | 5/1951 | Carrick | 98/94.1 |
| 2,750,868 | 6/1956 | Mieczkowski et al. | 236/49.3 X |
| 3,967,779 | 7/1976 | Logsdon | 236/68 R |
| 4,136,822 | 1/1979 | Felter | 98/42.04 |
| 4,422,444 | 12/1983 | Webb, Jr. | 236/91 F |

OTHER PUBLICATIONS

Honeywell Manual on Solid State Economizer Logic Module.

*Primary Examiner*—William E. Wayner

*Attorney, Agent, or Firm*—William R. Clark; Richard M. Sharkansky

[57] ABSTRACT

A window fan with an electronic controller having an AUTO mode of operation that is responsive to the ΔT between inside and outside temperature, a minimum inside temperature threshold, and the outside relative humidity. Accordingly, if it is relatively hot or humid outside, or if it is relatively cold inside, the window fan is inactive. Thus, the fan is automatically activated only during those time periods when it is most advantageous to ventilate with outside fresh air.

16 Claims, 5 Drawing Sheets

WINDOW FAN WITH CONTROLLER

This application is a continuation of application Ser. No. 332,192 filed Mar. 30, 1989 now abandoned.

BACKGROUND OF THE INVENTION

The field of the invention generally relates to a fan positioned so as to force outside fresh air into a room, and more particularly relates to an electronic controller that automatically controls the operation of such a fan.

Window fans are in widespread usage for blowing outside fresh air into buildings such as residential homes or apartments. Although a window fan does not have a heat exchanger like an air conditioner to cool the air, a fan has a significant advantage in that it is relatively inexpensive to purchase and operate. Also, fans may have a considerable advantage over room air cleaners such as electrostatic cleaners because fans have much higher flow rates. In other words, even though electrostatic cleaners remove particles such as smoke from indoor air, considerable time is required to clear a smokey room because the air flow rate of an electrostatic cleaner is relatively small. A window fan, on the other hand, has a relatively high air flow rate and can clear a room of smoke in a relatively short time period.

One disadvantage of fresh air exchange fans is that their operation must generally be closely monitored and regulated because there are only certain conditions under which operation is advantageous; other times, they will make the inside environment more uncomfortable. For example, during the hot summer months when it is most desirable to use fans, the outside air may be hotter and more humid than the inside air during the mid-portion of the day. This, of course, is especially true if the room is also served by an air conditioner. Accordingly, if a fresh air exchange fan is forcing outside air into the room during the hottest hours of the day, the room will become hotter and more humid. Generally, the proper time for operation of a window fan is later in the day after the inside temperature has climbed above the outside temperature or after it has cooled down outside; then, the outside fresh air can be forced into the room to remove heat that has built up during the day. Also, if an intake fan is operated while it is raining, rain water may be directed into the room.

SUMMARY OF THE INVENTION

In accordance with the invention, a fan is adapted for bringing outside air into a building, which fan comprises means for providing a signal representative of the difference between the temperature inside the building and the temperature outside the building, and means responsive to the signal for activating the fan. It may also be preferable that the activating means further be responsive to means for comparing the inside temperature with a predetermined reference. The activating means may also be responsive to a switch that measures the outside relative humidity. The signal providing means may comprise a pair of thermal sensors such as thermistors, one of which is positioned so as to be responsive to the inside temperature and the other positioned so as to be responsive to the outside temperature.

With such arrangement, the fan can be placed into an automatic mode of operation wherein the fan is only operated if the outside temperature is less than the inside temperature by a predetermined amount, the inside temperature is above a predetermined temperature, and the outside humidity is below a predetermined amount. Accordingly, at such times during the day that it is hotter outside than inside, the fan will be deactivated so that the room will not be further heated by introducing relatively hot air from outside. Also, if the inside temperature is relatively low such as, for example, 55°, outside air will not be introduced into the room. Also, if the outside humidity is relatively high such as when it is raining, the fan will be deactivated so that high humidity air and/or rain water will not be directed into the room.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENT

Figure 1:
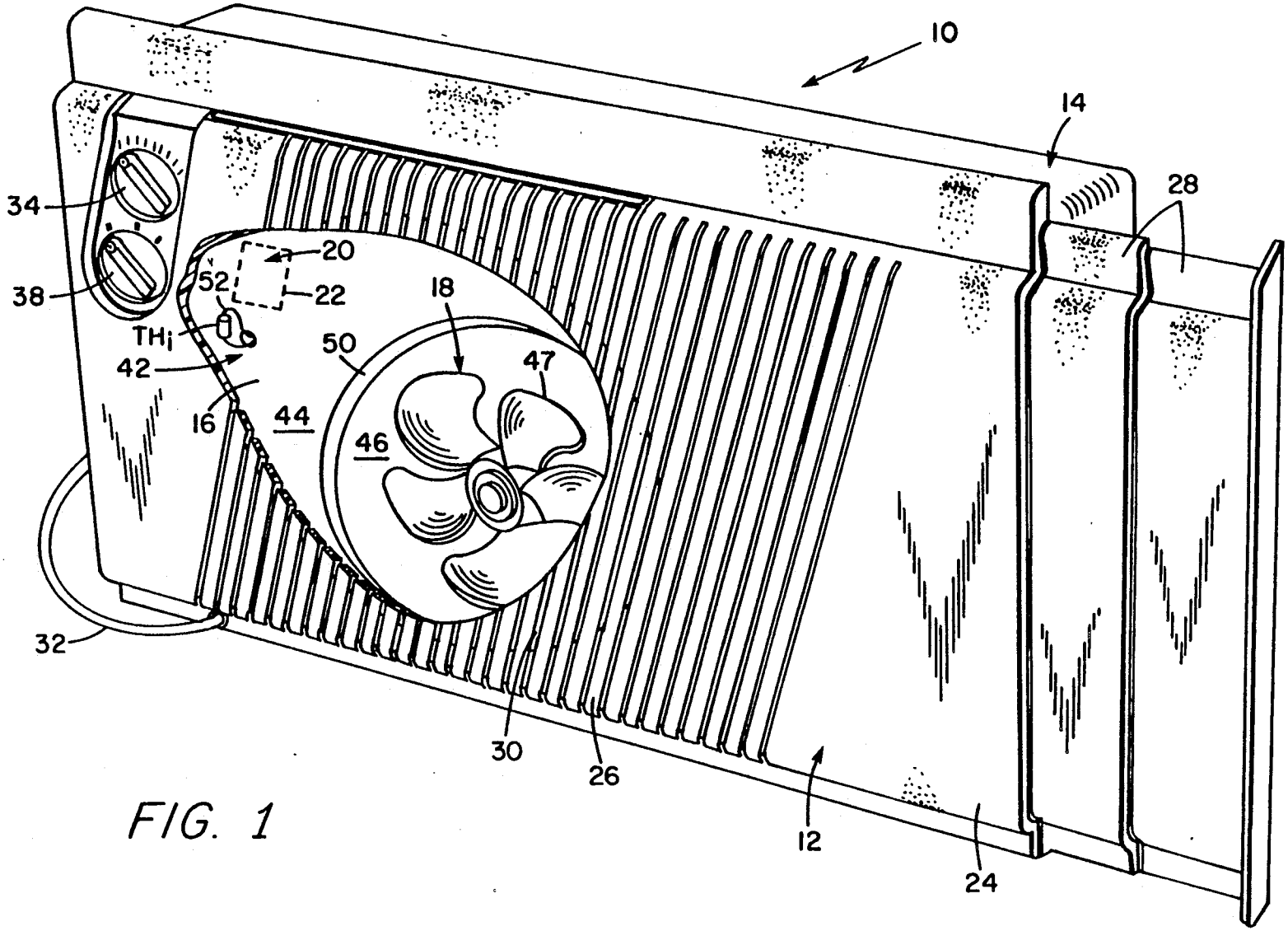
FIG. 1 is a partially broken-away perspective view of a window fan.

Referring generally to the drawings wherein like reference numerals refer to like parts throughout the several views, a window fan 10 in accordance with the invention includes inside and outside thermal sensors such as thermistors $TH_i$ and $TH_o$ that provide a signal $V_0$ that is representative of the temperature differential or $\Delta T$ between inside and outside. $V_0$ is used to control transistor 104. Also, the inside temperature is compared to a reference signal in comparator 122 to ensure that the inside temperature is not already too cool. The output of comparator 122 controls transistor 106. Further, a humidity switch 36 senses whether it is too humid outside. In the AUTO mode of operation, louvers 60 are automatically opened and fan motor 48 is energized only if transistors 104 and 106 are turned on and humidity switch 36 is closed. In other words, window fan 10 is only operated in the AUTO mode if there is a predetermined $\Delta T$, the inside temperature is above a predetermined threshold, and the outside relative humidity is not too high.

Figure 4:
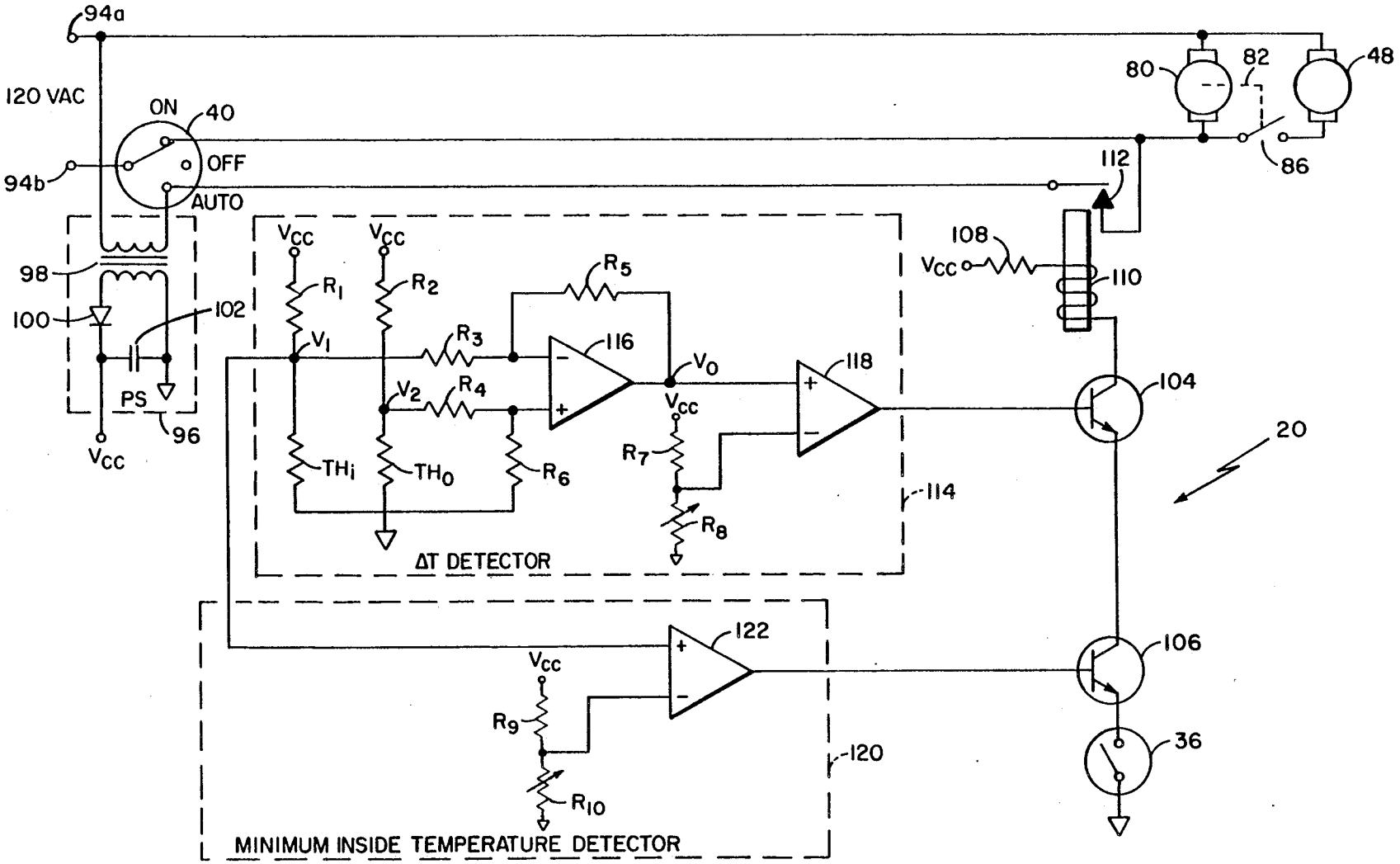
FIG. 4 is a schematic diagram of the controller of the window fan.

Referring now specifically to FIG. 1, window fan 10 includes an inside casing 12, outside casing 14, an inner partition 16 or baffle to which the fan 18 is mounted, and a controller 20 which preferably is on a circuit board 22 also mounted to partition 16. Inside casing 12, which may be made from molded plastic, includes a front surface 24 having a grill 26, and lateral side extensions 28 that are used to seal window fan 10 in windows of different lateral widths. Grill 26 here has a plurality of slots 30 through which window fan 10 directs outside air into the room to be cooled. A power cord 32 extends from the front of inside casing 12 so that the window fan 10 can be conveniently installed and plugged into an AC wall receptacle. Control knob 34 is used to adjust humidity switch 36 (FIG. 4), and control knob 38 is used to control three-position switch 40 (FIG. 4). Although fan 10 is here described as a window fan that directs air from outside into a room, those skilled in the art will recognize that the invention could also be used to advantage with wall or ceiling mounted fans including those that expell air rather than direct it inwardly.

Inside casing 12 and outside casing 14 form an interior compartment 42 that is divided into an inside chamber 44 and outside chamber 46 by lateral vertical partition 16. Fan 18, which includes fan blades 47 and fan motor 48, is mounted to the rear of partition 16. As an example, fan blades 47 could have a 9-inch diameter and provide 200 cfm with a fan motor 48 having a rating of 3600 rpm at 35W and 0.45 amps. Air inlet opening 50 is located in front of fan 18. Circuit board 22 for controller 20 is here mounted to the rear of partition 16, and inside thermistor $TH_i$, which is responsive to the inside temperature, is located in the inside chamber 44, and is interconnected by wires 52 to circuit board 22.

Figure 2:
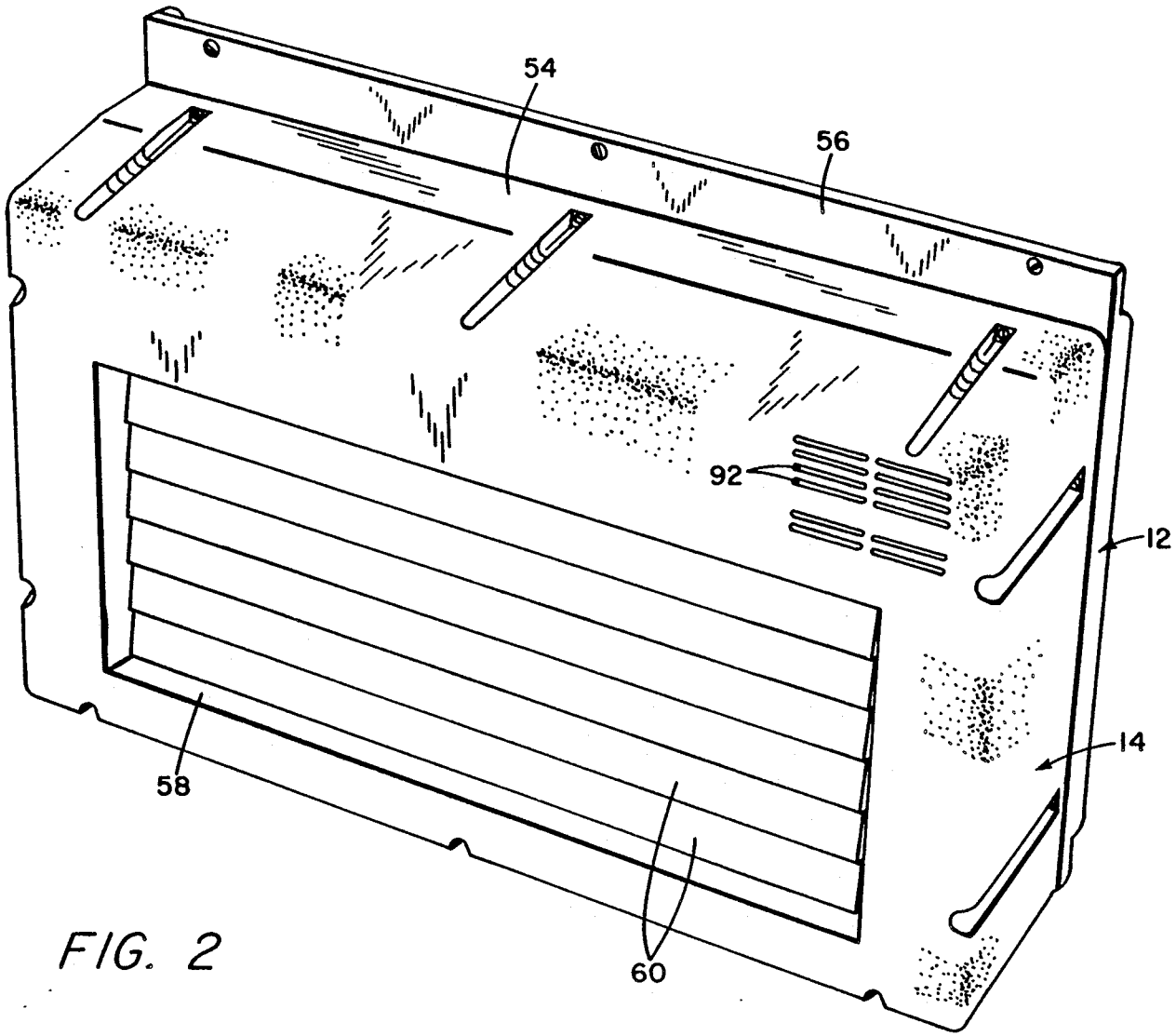
FIG. 2 is a rear perspective view of the window fan.
Figure 3:
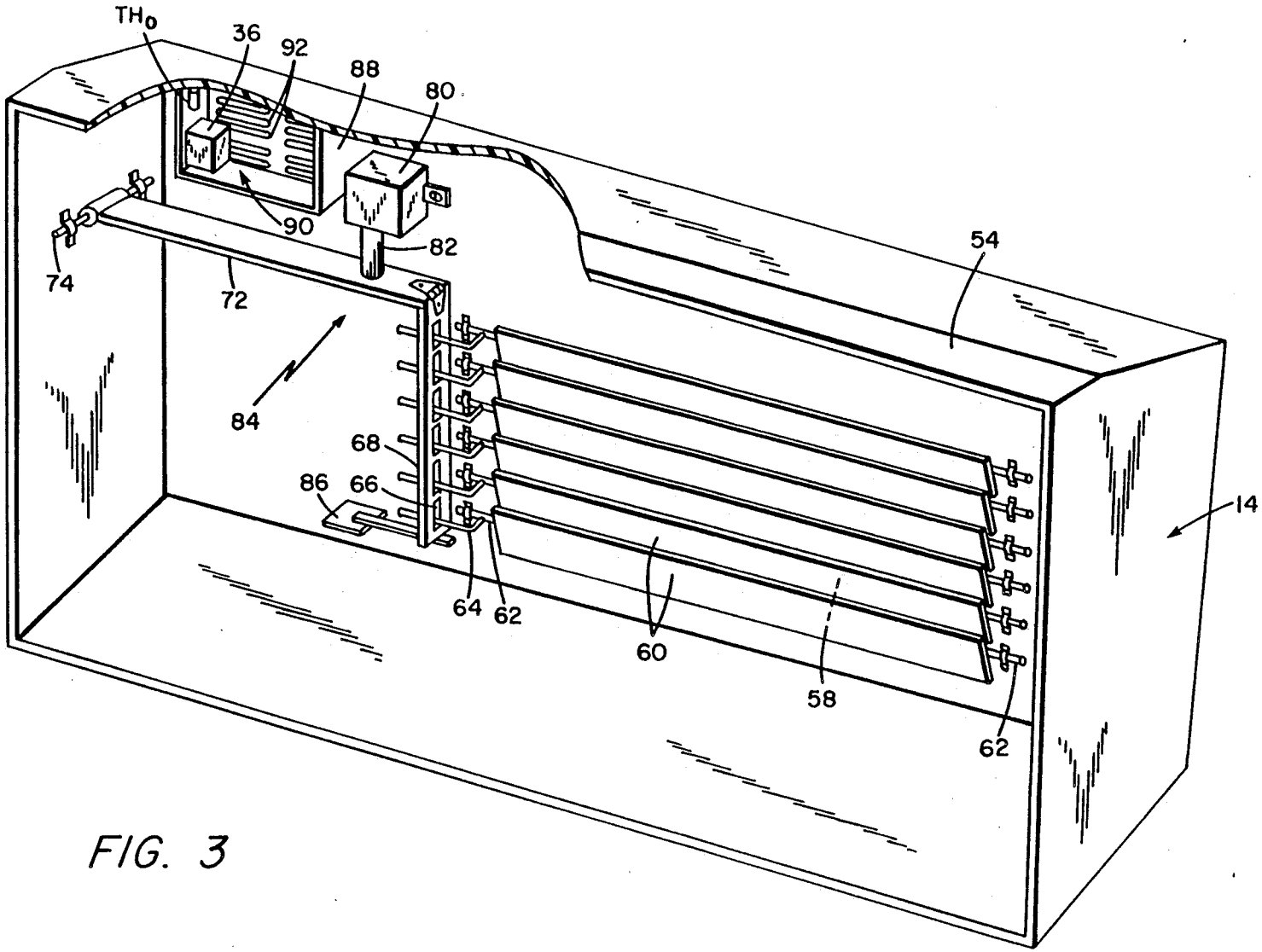
FIG. 3 is a view inside of the outer casing of the window fan.

Referring to FIG. 2, a rear perspective view of outer casing 14 is shown. Also, FIG. 3 shows an inside view of outer casing 14 with the inner casing 12 removed. Outer casing 14 has a flat annular band 54 that, on the bottom, seats down on the window frame and, on the top, is engaged by the window. A lip 56 of the inside casing 12 extends above the band 54 and seats against the front surface of the window. Outside casing 14 has a large aperture 58 in the rear in which louvers 60 or dampers are horizontally aligned. Although there are many mechanical arrangements by which louvers 60 could be automatically controlled, here each louver 60 has laterally extending pins 62 that are pivotally mounted in suitable manner so that louvers 60 can be rotated in unison between an open position and a closed position. As shown in FIG. 3, the pin 62 on one end of each louver 60 has a right angle arm 64 that inserts through a corresponding hole 66 of an actuator bar 68. The top of actuator bar 68 is hinged to one end of lever arm 72 that has the opposite end pivotally connected to a pivot-bar 74. A wax motor 80 is mounted so that when its plunger 82 extends downwardly, the plunger 82 causes lever arm 72 to rotate downwardly about pivot bar 74 thereby pushing actuator bar 68 downwardly. When window fan 10 and wax motor 80 are deactivated, actuator bar 68 is biased upwardly by suitable means such that louvers 60 are closed and sealed as shown in FIGS. 2 and 3. If, however, wax motor 80 is energized, plunger 82 pushes lever arm 72 and actuator bar 68 downwardly causing right-angle arms 64 to move downwardly so as to rotate louvers 60 open. Accordingly, an automatic louver system 84 is provided to open and close louvers 60 in response to the operational state of wax motor 80. Microswitch 86, which is normally open, is positioned adjacent to actuator bar 68 so as to sense whether louvers 60 are open or closed. That is, when actuator bar 68 moves downwardly thus opening louvers 60, it also closes microswitch 86.

Panels 88 provide a small pocket 90 in which humidity switch 36 and outside thermistor $TH_o$ are mounted. Pocket 90 has vent holes 92 communicating outside so that humidity switch 36 and outside thermistor $TH_o$ are respectively responsive to the outside humidity and temperature. Humidity switch 36 and thermistor $TH_o$ are interconnected to circuit board 22 of controller 20.

Referring to FIG. 4, a schematic diagram of controller 20 is shown. 120 VAC line voltage is applied through power cord 32 to terminals 94*a* and *b*. As determined by control knob 38, three-position switch 40 controls the operational mode of controller 20. When switch 40 is in the ON position, 120 VAC is applied across conventional wax motor 80 that has a positive thermal coefficient heating element and gradually heats up until plunger 82 extends thereby forcing lever arm 72 and actuator bar 68 downwardly to open louvers 60. An example of a wax motor is Part No. 100217 of Eltek s.p.a of Valenza, Italy. The downward position of actuator bar 68, that is indicative of the louvers 60 being open, closes microswitch 86 thereby applying 120 VAC across fan motor 48. Thus, when control knob 38 is switched from the OFF position to the ON position, there is a small time delay in which the heating element of the wax motor 80 heats up, and then the plunger 82 of wax motor 80 slowly and quietly opens the louvers 60 and then activates fan 18. In the ON mode, louvers 60 remain open and fan remains activated until control knob 38 is switched to the OFF position.

Still referring to FIG. 4, the fan 18 is deactivated and the louvers 60 are closed when, in response to control knob 38, three-position switch 40 is positioned in the OFF position. When three-position switch 40 is in the AUTO position, 120 VAC line voltage is applied to power supply 96 to generate $V_{CC}$, which may, for example, be +12 VDC. More specifically, power supply 96 includes step down transformer 98, half wave rectifying diode 100, and filter capacitor 102. $V_{CC}$ is applied to the indicated terminals of controller 20. When transistor 104 and 106 are turned on and humidity switch 36 is closed, current flows through resistor 108 and relay 110, and then to ground through transistors 104 and 106 and humidity switch 36. In such mode, the contacts 112 of relay 110 close and 120 VAC is applied across wax motor 80 as described heretofore with reference to the ON mode of switch 40. Thus, when transistors 104 and 106 are turned on and humidity switch 36 is closed, window fan 10 operates in the same manner as in the ON mode except that subsequent operation is interrupted if transistor 104 or transistor 106 is turned off, or humidity switch 36 is opened. In other words, transistors 104 and 106 and humidity switch 36 each has to be in a predetermined operational state for the automatic louver system 84 and the fan motor 48 to be activated, and if any one is in the opposite state, the fan motor 48 is off and the louvers 60 are closed because relay 110 is not energized.

The base of transistor 104 and thus its on/off state is controlled by inside/outside temperature differential detector 114 that uses $V_1$ and $V_2$ that are signals respectively representative of the inside and outside temperature. More specifically, $V_1$ is the voltage potential between $R_1$ and inside thermistor $TH_i$ that form a voltage divider branch between $V_{cc}$ and ground. Thus, $V_1=[V_{cc}/(R_1+TH_i)]TH_i$ where $TH_i$ is the resistance of inside thermistor $TH_i$ which, as described with reference to FIG. 1, is located on the room side of partition 16 and therefore is responsive to the room temperature. In an alternate embodiment, inside thermistor $TH_i$ could be positioned in any location wherein its resistance would accurately reflect or be responsive to the inside or room temperature. Similarly, $V_2$ is the voltage potential between $R_2$ and outside thermistor $TH_o$ that form a second voltage divider branch between $V_{cc}$ and ground. Thus, $V_2=[(V_{cc}/(R_2+TH_o)]TH_o$. $V_1$ and $V_2$ are respectively connected through equal resistors $R_3$ and $R_4$ to the inputs of difference amplifier 116, and resistors $R_5$ and $R_6$ are equal so that the gain for $V_1$ and $V_2$ are matched. Accordingly, difference amplifier 116 output $V_0=K(V_2-V_1)$ where $K=R_5/R_3$. $V_0$ is therefore a function of the voltage potential difference between $V_2$ and $V_1$, and therefore is a function of the temperature difference or ΔT between outside and inside temperature.

$V_0$ is coupled to comparator 118 and compared to a reference voltage provided by the voltage divider branch of $R_7$ and $R_8$. The values of resistors $R_1$–$R_8$ and the characteristics of inside and outside thermistors $TH_i$ and $TH_o$ are selected so that the output of comparator 118 turns on transistor 104 when the inside temperature is 10 or more ° F. higher than the outside temperature. Otherwise, transistor 104 is turned off. Illustrative values are $R_{1=R2}=10K$ ohms, $R_3=R_4=1K$ ohms, $R_5=R_6=100K$ ohms, with thermistors $TH_i$ and $TH_o$ having negative thermal coefficients. It may be preferable to provide hysteresis for comparator 118 so that its output does not tend to fluctuate thereby intermittently turning transistor 104 off and on.

Still referring to FIG. 4, the base and thus the on/off state of transistor 106 is determined by minimim inside temperature detector 120. $V_1$ which, as described heretofore, is a signal representative of the inside temperature, is coupled to comparator 122. A reference signal is provided to comparator 122 by the voltage divider branch of $R_9$ and $R_{10}$ such that the output of comparator 122 turns on transistor 106 when the inside temperature is 55° F. or higher. Otherwise, the output of comparator 122 turns transistor 106 off.

Humidity switch 36 is a commercially available device such as a model J11 available from Ranco of Plain City, Ohio. Generally, humidity switch 36 is open when its environmental humidity is above a predetermined level, and it is closed when below. It may be desirable to be able to adjust the humidity level at which humidity switch opens, and accordingly, control knob 34 with a suitable linkage is provided for adjusting humidity switch 36. As described heretofore, humidity switch 36 is located in pocket 90 that has holes 92 communicating with the outside, so humidity switch 36 is responsive to the outside humidity.

In the AUTO mode of operation, the contacts 112 of relay 110 close thereby opening louvers 60 and turning on fan motor 48 only if all of three conditions are met. First, there must be a predetermined temperature differential ΔT such as, for example, +10° F. between inside and outside temperature as controlled by inside/outside temperature differential detector 114. Second, the room or inside temperature must be above a predetermined temperature such as 55° F. Third, the outside relative humidity must be below a predetermined level such as, for example, 65%. These conditions provide advantageous operation under many conditions and in different climates, and may have particular advantage when used in conjunction with a room air conditioner in certain climates. For example, if it is hot outside during the day such that the inside temperature is not more than 10° hotter than outside, fan motor 48 will be off because the inside/outside temperature differential ΔT will be less than +10° F. Also, the louvers 60 will remain shut and sealed so that if a room air conditioner is operating, it will operate without leakage through window fan 10. If the outside temperature cools during the night such that the room is 10 or more degrees warmer, inside/outside temperature differential detector 114 detects this condition and turns on transistor 104. Provided the inside temperature is above 55° F. and the outside humidity is less than a predetermined level, louvers 60 open and fan 18 is turned on so as to force the relatively cool outside fresh air into the room. If an air conditioner is being used, it will then become inactive in response to its own internal thermostat. Whether an air conditioner is being used or not, the fan will continue to ventilate the room with relatively cool fresh outside air. In certain climates and seasons of the year such as fall, the outside temperature may be relatively cold, in which case, when the inside thermistor $TH_i$ indicates that the room has cooled down to 55° F., fan 18 is deactivated and the louvers 60 are automatically sealed. In other words, fan 18 shuts off and the room is sealed if the operation of the fan would tend to cool the room down too much. In addition to preventing outside air from being directed into the room when the outside air is very humid or muggy, humidity switch 36 also has the advantage of shutting louvers 60 when it rains outside thereby avoiding spraying water into the room.

Figure 5:
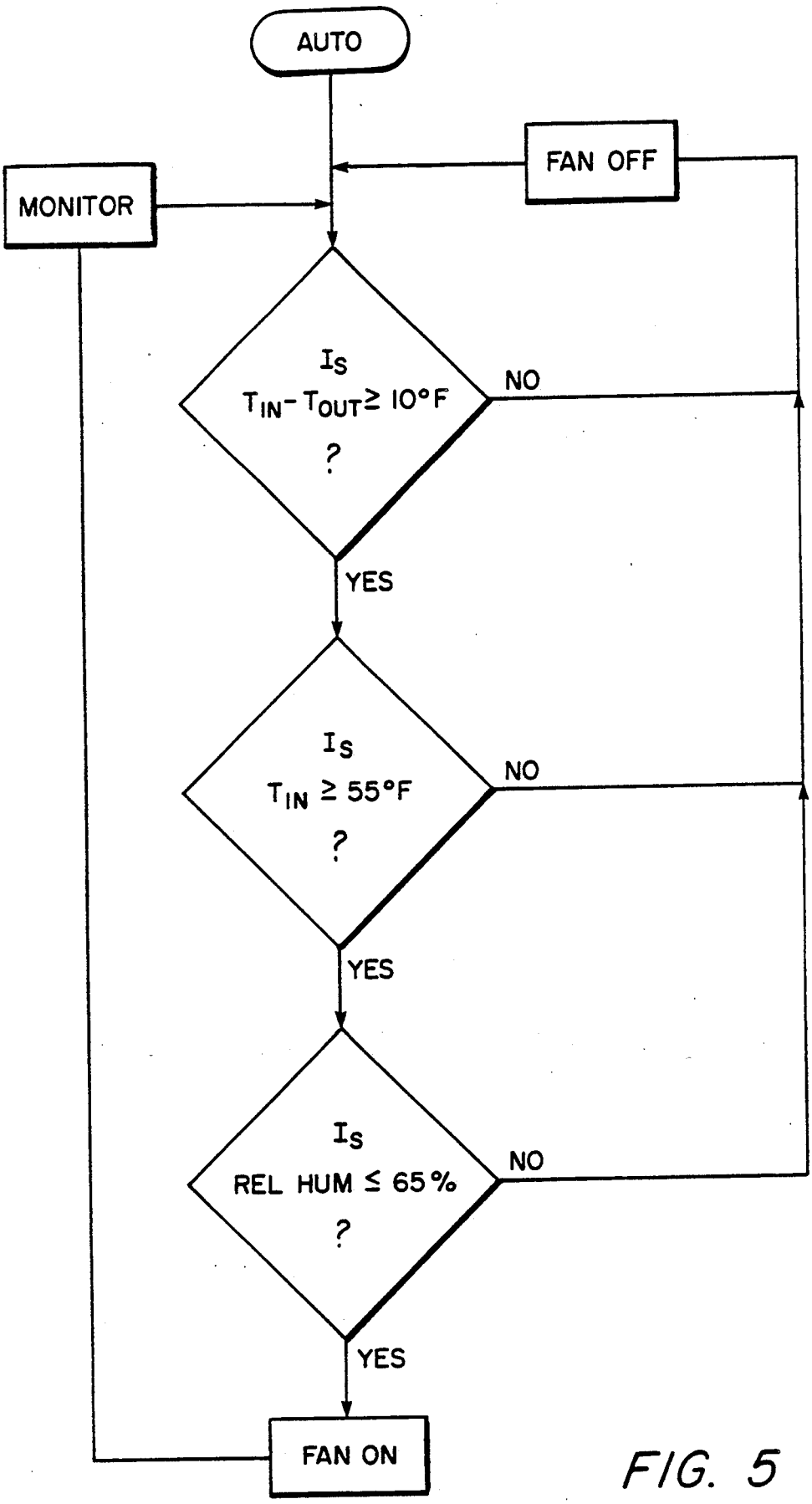
FIG. 5 is a flow diagram of an alternate embodiment controller.

One advantage of window fan 10 is that it is a stand alone unit that is relatively inexpensive to buy and easy to install. In an alternate embodiment, a programmed digital controller could be used instead of controller 20 shown in FIG. 4 and described with reference thereto. In such case, well-known programming principles would be employed to implement the control functions shown in FIG. 5. For example, in the AUTO mode, the controller first determines if the inside temperature $T_{in}$ minus the outside temperature $T_{out}$ is 10° F. or more. If not, the controller goes into a loop continuously checking the relationship between $T_{in}$ and $T_{out}$, and the fan remains off. If it is 10° F. or more cooler outside, the controller next checks to see if the inside temperature $T_{in}$ is at least 55° F. If it is not, the controller continues in a loop with the fan off. If it is, the controller checks to see if the outside relative humidity is less than some preset level such as, for example, 65%. If it is not, the program goes into a loop rechecking the above parameters because it is undesirable to bring in humid outside air. If, however, the outside humidity is below the preset level, the louvers 60 are opened and the fan 18 is turned on. Once on, the controller continues to monitor the ΔT, $T_{in}$ and the relative humidity. In the event that one of the tests subsequently fails, the fan will be turned off and the louvers closed.

This concludes the description of the preferred embodiment. A reading of it by those skilled in the art will bring to mind many modifications and alterations without departing from the spirit and scope of the invention. Accordingly, it is intended that the scope of the invention be limited only by the appended claims.

What is claimed is:

1. A fan adapted for bringing outside air into a building, comprising:

means for providing a signal representative of the difference between the temperature inside the building and the temperature outside the building;

a humidity switch responsive to the humidity outside said building; and means responsive to said signal and said humidity switch for activating said fan when there is a predetermined temperature differential between inside and outside said building, and when the humidity outside said building is below a predetermined amount.

2. The fan recited in claim 1 further comprising means for comparing said temperature inside said building with a predetermined reference, said activating means also being responsive to said comparing means wherein said fan is only activated when said temperature inside said building is above a predetermined temperature.

3. The fan recited in claim 1 further comprising louvers and means for automatically opening said louvers when said fan is activated.

4. The fan recited in claim 1 wherein said signal providing means comprises a first thermal sensor responsive to said temperature inside said building and a second thermal sensor responsive to said temperature outside said building.

5. A controller for a fan adapted for providing a flow of outside air into a building, comprising:

means for providing a first signal corresponding to the difference between the temperature inside the building and the temperature outside the building;

means for comparing said temperature inside said building with a predetermined reference and providing a second signal in accordance therewith;

a humidity switch responsive to the humidity outside said building; and means responsive to said first and second signals and said humidity switch for activating said fan only when there is a predetermined positive temperature differential between inside and outside temperature, the inside temperature is above a predetermined temperature, and the outside humidity is below a predetermined amount of humidity.

6. The controller in claim 5 wherein said first signal providing means comprises a first temperature sensor positioned so as to be responsive to said temperature in said building and a second thermal sensor positioned so as to be responsive to said temperature outside said building.

7. The controller recited in claim 6 wherein said first and second thermal sensors are thermistors.

8. The controller recited in claim 5 wherein said activating means is responsive to a temperature differential between the inside temperature and the outside temperature of approximately 10° F.

9. The controller recited in claim 5 wherein said activating means deactivates said fan if the inside temperature of the building is less than a predetermined temperature.

10. The fan recited in claim 9 wherein said predetermined temperature is approximately 55° F.

11. The fan recited in claim 5 wherein said activating means deactivates said fan if the outside relative humidity is above a predetermined level.

12. The fan recited in claim 11 wherein said predetermined level is approximately 65%.

13. A self-contained window fan adapted for mounting in a window and directing a forced flow of outside air into the room of the building in which it is mounted, comprising:

a fan housing including an inside casing, an outside casing, and a partition intermediate said inside and outside casings;

a fan blade and motor mounted to said housing, said fan blade being oriented to blow outside air into said room through said window;

a first thermal sensor mounted to said housing and being located so as to be responsive to the inside temperature in said room;

a second thermal sensor mounted to said housing and being located so as to e responsive to the temperature outside said building;

means responsive to said first and second thermal sensors for providing a first signal representative of the temperature differential between inside said room and outside said building;

means responsive to said first thermal sensor for providing a second signal corresponding to whether the temperature inside the building is above a predetermined threshold temperature;

a humidity switch mounted to said housing and being located so as to be responsive to the humidity outside said building;

means responsive to said first and second signals and said humidity switch for activating said fan when there is a predetermined temperature differential between inside said room and outside said building, the temperature inside said room is above a predetermined threshold temperature, and the outside humidity is below a predetermined humidity; and louvers and means for automatically opening said louvers in approximate unison with the activation of said fan wherein, when said fan is deactive, said louvers are closed thereby sealing said room from outside weather conditions.

14. The fan recited in claim 13 wherein said opening means comprises a wax motor.

15. The method of controlling a fan adapted for mounting in a window and blowing outside air into the room of the building in which it is mounted, comprising the steps of:

providing a first signal corresponding to the temperature inside the room;

providing a second signal corresponding to the temperature outside the building;

providing a third signal corresponding to the difference between said first and second signals;

providing a switch that closes when the outside humidity is below a predetermined amount; and controlling said fain in accordance with said third signal and said switch wherein said fan is not activated unless there is a predetermined temperature differential between said room and outside, and unless the outside humidity is below a predetermined amount.

16. The method recited in claim 15 further comprising the step of providing a fourth signal corresponding to whether the inside temperature is above a predetermined threshold level, and activating said fan also in accordance with said fourth signal.

* * * * *